US007252363B2

(12) United States Patent
Takagi et al.

(10) Patent No.: US 7,252,363 B2
(45) Date of Patent: Aug. 7, 2007

(54) INKJET PRINTER

(75) Inventors: Osamu Takagi, Nagoya (JP); Tsugio Okamoto, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 276 days.

(21) Appl. No.: 10/947,416

(22) Filed: Sep. 23, 2004

(65) Prior Publication Data

US 2005/0062793 A1 Mar. 24, 2005

(30) Foreign Application Priority Data

Sep. 24, 2003 (JP) ..... 2003-331521

(51) Int. Cl.
*B41J 2/165* (2006.01)

(52) U.S. Cl. ..... 347/29; 347/23; 347/30; 347/32

(58) Field of Classification Search ..... 347/22–35
See application file for complete search history.

(56) References Cited

U.S. PATENT DOCUMENTS

| | | | | |
|---|---|---|---|---|
| 4,369,456 | A * | 1/1983 | Cruz-Uribe et al. | 347/33 |
| 4,371,881 | A | 2/1983 | Bork et al. | |
| 5,424,760 | A * | 6/1995 | Wirth et al. | 347/222 |
| 5,870,115 | A | 2/1999 | Kikuchi et al. | |
| 5,883,645 | A | 3/1999 | Ikado et al. | |

FOREIGN PATENT DOCUMENTS

| | | |
|---|---|---|
| EP | 0 676 292 A2 | 10/1995 |
| GB | 2 087 800 A | 6/1982 |
| JP | A 58-076289 | 5/1983 |
| JP | A-63-254044 | 10/1988 |
| JP | A-2-258351 | 10/1990 |
| JP | A-5-131639 | 5/1993 |
| JP | A-5-131720 | 5/1993 |
| JP | A-5-318754 | 12/1993 |
| JP | A 7-314659 | 12/1995 |
| JP | A-9-123470 | 5/1997 |
| JP | A 9-239999 | 9/1997 |
| JP | A 10-230657 | 9/1998 |
| JP | A-11-207978 | 8/1999 |
| JP | A-2000-343716 | 12/2000 |
| JP | A 2001-293874 | 10/2001 |
| JP | A-2002-225257 | 8/2002 |
| JP | A 2003-63691 | 3/2003 |
| JP | A-2003-94676 | 4/2003 |

* cited by examiner

*Primary Examiner*—Shih-Wen Hsieh
(74) *Attorney, Agent, or Firm*—Oliff & Berridge, PLC

(57) ABSTRACT

An inkjet printer includes a recording head, a conveyance mechanism, a shutter, a storage portion, and a moving mechanism. The recording head includes an ejection surface in which an ejection port for ejecting ink is defined. The conveyance mechanism conveys a printing medium while the printing medium is facing the ejection surface. The shutter covers the ejection surface. The storage portion stores the shutter. The moving mechanism moves the shutter from the storage portion to a facing position while the shutter is separate from the ejection surface. The shutter faces and covers the ejection surface at the facing position.

16 Claims, 11 Drawing Sheets

INKJET PRINTER

BACKGROUND OF THE INVENTION

1. Field of the Invention

The present invention relates to an inkjet printer for ejecting ink from nozzles of a recording head onto a printing medium so as to form an image.

2. Description of the Related Art

In the related art, inkjet printers that execute printing by ejecting very small ink droplets from a plurality of nozzles provided in a recording head are classified into so-called serial head type printers and so-called line head type printers. Each of the serial head type printers executes printing by the combination of a main-scanning-direction moving operation for ejecting ink while moving a recording head in a main scanning direction (paper width direction) and a sub-scanning-direction moving operation for moving paper in a sub-scanning direction. On the other hand, each of the line head type printers includes a line head having a printable width corresponding to the paper width of paper as a printing medium. In the line head type printer, printing is performed while moving the line head and the paper relatively to each other. Particularly in the line head type printer, it is unnecessary to move the recording head in the main scanning direction of the paper. Thus, the print speed can be increased in comparison with that in the serial head type printer.

In each of the serial head type printer and the line head type printer in the related art, ink ejection from minute nozzles provided in the recording head must be kept good in order to obtain a high quality image. Therefore, in inkjet printers, so-called capping, purging and flushing are performed. Capping is an operation of sealing ink ejection ports (nozzle outlets) of the recording head with a cap. Purging is an operation of sucking ink in the nozzles from the ejection port side or discharging compressed ink forcibly from the ink ejection ports to thereby eject the ink from nozzles. Flushing is an operation of ejecting a small amount of ink at the time of printing. Capping can prevent the viscosity of ink in the nozzles from increasing, and prevent foreign matters or the like from being mixed into the ink.

JP-A-2001-293874 (pages 5 to 6; and FIG. 8) discloses an inkjet printer including a movable shutter having a cap. According to the technique disclosed in JP-A-2001-293874, the shutter is moved to cap ink ejection ports when a recording head is not in use.

SUMMARY OF THE INVENTION

In order to obtain an excellent image, not only is it necessary to prevent the viscosity of ink in nozzles from increasing, but it is also necessary to protect each meniscus properly. The meniscus means the surface where ink in each nozzle of the recording head borders on the atmosphere. The meniscus has influence on the flying condition of the ink. Accordingly, when the meniscus is broken, the ink cannot be ejected satisfactorily. As a result, the printing quality is degraded. The meniscus can be restored to its proper condition by the aforementioned purging operation. However, the amount of ink discharged in the purging operation is larger than that in the flushing operation. In addition, it takes more time in the purging operation.

Assume that a paper jam occurs near the recording head during printing. In this case, the paper jam may be solved as follows. That is, the cover of the apparatus is opened, and a hand or the like is inserted into the portion where the recording head is disposed. However, the hand, the paper, or the like, may touch the recording head, particularly the ejection surface so that menisci are broken. The menisci are broken due to a shock given to the recording head by the hand or the like touching the recording head, or due to the hand or the like touching the ejection surface to thereby make ink inside the nozzles adhere to the hand or the like.

In addition, when the hand touches the recording head, the hand is smeared with the ink adhering thereto. When the hand smeared with the ink touches a paper conveyance path, the ink adhering to the hand is transferred to a portion forming the paper conveyance path. Thus, there occurs another problem that paper conveyed in the paper conveyance path is contaminated with the transferred ink so that the printing quality is degraded.

The invention provides an inkjet printer in which a hand is prevented from directly touching a recording head to smear the hand, so that the printing quality can be kept good.

In order to solve the foregoing problems, according to one embodiment of the invention, an inkjet printer includes a recording head, a conveyance mechanism, a shutter, a storage portion, and a moving mechanism. The recording head includes an ejection surface in which an ejection port for ejecting ink is defined. The conveyance mechanism conveys a printing medium while the printing medium is facing the ejection surface. The shutter covers the ejection surface. The storage portion stores the shutter. The moving mechanism moves the shutter from the storage portion to a facing position while the shutter is separate from the ejection surface. The shutter faces and covers the ejection surface at the facing position.

With this configuration, a hand is prevented from touching a recording head directly to smear the hand at the time of maintenance for solving a paper jam, so that the printing quality of the inkjet printer can be kept good.

DETAILED DESCRIPTION OF THE PREFERRED EMBODIMENT

Embodiment 1

A preferred embodiment of the invention will be described below with reference to the drawings.

Figure 1:
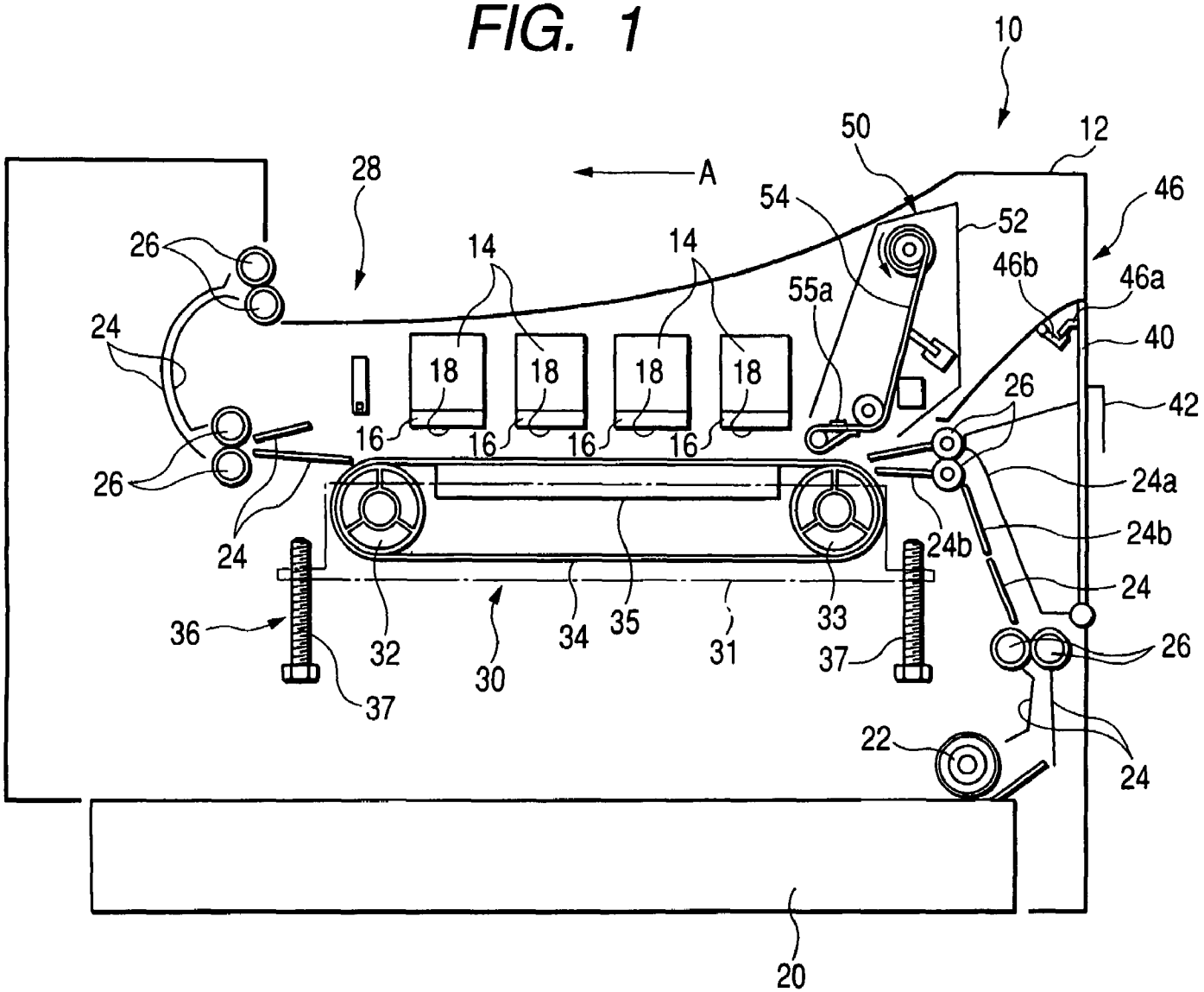
FIG. 1 is a side view showing the overall configuration of an inkjet printer 10 according to Embodiment 1 of the invention.
Figure 2:
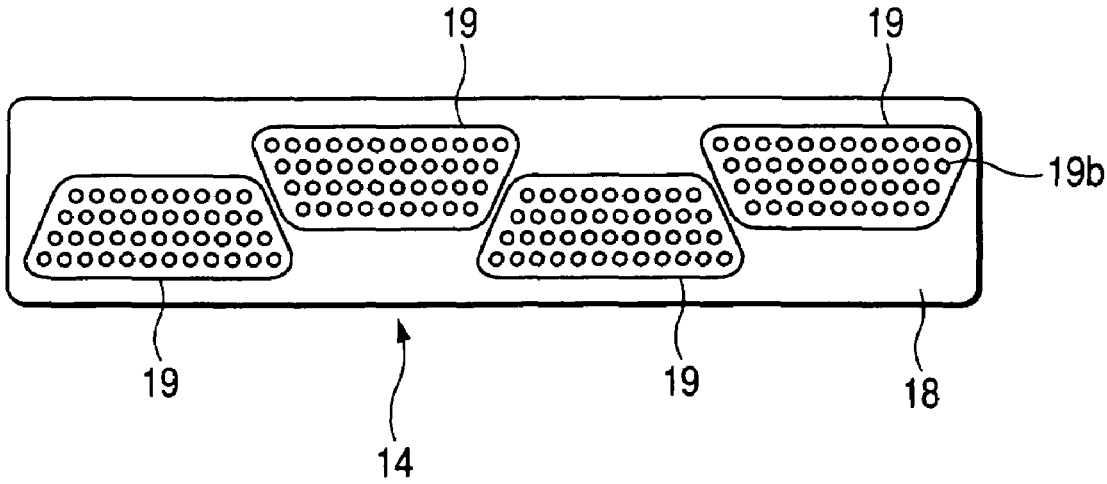
FIG. 2 is a plan view of a recording head 14, when viewed from an ejection surface 18.
Figure 3A:
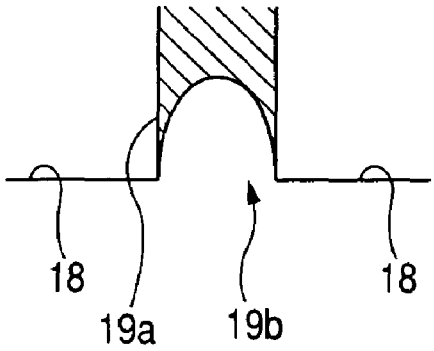
FIGS. 3A and 3B are explanatory views showing the state of a head body 16 near an ejection port 19*b*.
Figure 3B:
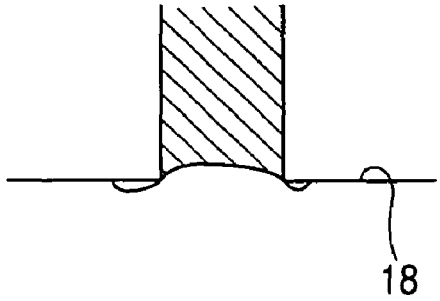

First, an inkjet printer according to Embodiment 1 of the invention will be described with reference to FIGS. 1-3B. FIG. 1 is a side view showing the overall configuration of an inkjet printer 10 according to this embodiment. FIG. 2 is a plan view of a recording head 14, when viewed from an ejection surface 18. FIGS. 3A and 3B are explanatory views showing the conditions of a head body 16 near an ejection port 19*b*.

The inkjet printer 10 shown in FIG. 1 is a line-head-type color inkjet printer having four line-type recording heads 14 in a housing 12 of the printer. That is, the inkjet printer 10 is a line-printing-type inkjet printer in which the positions of the recording heads 14 are fixed at the time of printing and which forms an image on a printing medium conveyed by a conveyance unit 30, which will be described later. A paper tray 20 is provided at a lower part of the housing 12 of the inkjet printer 10, and a paper discharge tray 28 is provided on the top of the housing 12. In addition, the conveyance unit 30 having a conveyance belt 34 is provided in the central portion of the housing 12 in FIG. 1. The inkjet printer 10 is configured so that paper functioning as the printing medium is conveyed to pass under the recording heads 14 and an image is formed thereon.

Each recording head 14 includes a head body 16 in its lower end. Each head body 16 has nozzles 19*a* (see FIGS. 3A and 3B) and an actuator unit pasted together. Ink flow paths including pressure chambers are formed in the nozzles 19*a*, and the actuator unit applies pressure to ink in each pressure chamber. In the head body 16, ink is pushed out from each pressure chamber toward an ejection port 19*b* of a nozzle 19*a* by the actuator unit.

Each head body 16 has a rectangular shape in section (see FIG. 2). The head bodies 16 are disposed closely to each other so that their longitudinal directions are directions (perpendicular to the paper of FIG. 1) perpendicular to the paper conveyance direction (medium conveyance direction, the arrow A direction in FIG. 1). The bottom surface (ejection surface 18) of each head body 16 faces the paper conveyance path.

As shown in FIG. 2, a large number of ejection ports 19*b* each having a very small diameter corresponding to the nozzle 19*a* are provided in the ejection surface 18. Inks of magenta (M), yellow (Y), cyan (C) and black (K) are ejected from the four head bodies 16, respectively. Four ejection port groups 19 in which a plurality of ejection ports 19*b* are disposed densely are arranged side by side in the ejection surface 18 of each recording head 14 of this embodiment.

As shown in FIG. 3A, the surface of ink near the ejection port 19*b* in the nozzle 19*a*, which touches the atmosphere, forms a curved surface (meniscus). The meniscus has influence on the flying condition of the ink. It is therefore necessary to keep the meniscus properly in order to keep the printing quality. However, when a paper jam occurs, a hand may be inserted into the position where the recording head 14 is disposed. In such a case, there is a fear that the hand touches the ejection surface 18 so that the meniscus is broken as shown in FIG. 3B. In this event, the ink tends to return into the nozzle 19*a* due to the back pressure in the nozzle. As a result, ink remains on the ejection surface 18, or bubbles are mixed into ink in the nozzle 19*a*. In some cases, ink remains retracted from the vicinity of the ejection port 19*b* into the pressure chamber. Possible factors in causing the broken meniscus include a shock caused by the hand touching the ejection surface 18, and leakage of ink drawn out from the ejection port 19*b* due to a capillary phenomenon when the hand touches the ejection port 19*b*.

In order to restore the meniscus to its normal state, it is necessary to perform a so-called purging operation for compressing or sucking ink in the nozzle to thereby remove the ink. However, there is a problem that the purging operation wastes the ink, and it takes much time to perform the purging operation so that the printing operation cannot be resumed rapidly. To solve such a problem, the inkjet printer 10 according to this embodiment has a configuration, which will be described below.

Description will be made on a conveyance system of paper (printing medium) in the inkjet printer 10. As shown in FIG. 1, each recording head 14 is disposed to form a slight gap between the ejection surface 18 thereof and the conveyance belt 34. The paper conveyance path (medium conveyance path) is formed in this gap portion. With this configuration, when paper conveyed on the conveyance belt 34 is passing just under the four head bodies 16 in turn, ink of each color is ejected from each ejection port 19*b* toward the upper surface (printing surface) of the paper so that a desired color image is formed on the paper.

A paper feed roller 22 is disposed on the front side (the right side in FIG. 1) of the housing of the paper tray 20 of a stack of sheets of paper placed in the paper tray 20, the paper feed roller 22 feeds an uppermost sheet. Guide plates 24 and feed rollers 26 convey the paper fed out by the paper feed roller 22 to the conveyance unit 30. After that, an image is formed on the paper conveyed by the conveyance belt 34 of the conveyance unit 30, when the paper passes under the recording heads 20, and the paper is conveyed by the guide plates 24 and the feed rollers 26 and discharged to the paper discharge tray 28 as it is.

The conveyance unit 30 includes a frame 31, belt rollers 32 and 33, and a conveyance belt 34 laid between the two belt rollers. The belt rollers 32 and 33 are rotatably supported on the frame 31. The belt roller 32 is a driving roller, to which a driving force of a not-shown conveyance motor is transmitted so that the belt roller 32 rotates. The belt roller 33 is a driven roller, which is rotated by the torque of the conveyance belt 34 to which a torque is given in accordance with the rotation of the belt roller 32. A belt support member 35 having a substantially rectangular parallelepiped shape is disposed in a region surrounded by the conveyance belt 34. The belt support member 35 contacts at its top with the inner circumferential surface of the conveyance belt 34 to thereby support the conveyance belt 34.

The conveyance belt 34 is an endless belt formed out of a flexible material such as rubber and into a loop-like shape. The outer circumferential surface of the conveyance belt 34 is treated with silicon rubber. Thus, paper conveyed thereto can be retained on the outer circumferential surface thereof due to its adhesive force, and conveyed downstream (on the left side in FIG. 1) in the medium conveyance direction by the driving of the belt roller 32.

The conveyance unit 30 can move up and down by means of a unit moving mechanism 36 (conveyance mechanism moving unit) disposed in a position where the conveyance unit 30 is not in contact with a shutter mechanism 50, which will be described later. The unit moving mechanism 36 includes four guide shafts 37, a moving motor 120 (see FIG.

6), and a not-shown transmission mechanism for transmitting the driving force of the moving motor 120 to the four guide shafts 37.

The guide shafts 37 are formed to have bolt-like surfaces to engage with threaded holes provided in the four corners of the frame 31 of the conveyance unit 30 respectively. The guide shafts 37 are set so that their axial directions are vertical. The moving motor 120 supplies a driving force for rotating the guide shafts 37 around their axes. The driving force is transmitted to the guide shafts 37 through the transmission mechanism including gears and so on.

According to the unit moving mechanism 36 shown in FIG. 1, the moving motor 120 rotates forward so that the guide shafts 37 rotates. As a result, the bolt-like portions of the guide shafts 37 engage with the threaded holes of the frame 31 and slide thereon. Thus, the conveyance unit 30 is moved down (separated from the ejection surfaces 18). On the contrary, when the moving motor 120 rotates backward, the conveyance unit 30 rises (moves up in a direction to approach the ejection surfaces 18).

In the inkjet printer 10, a front cover 40, which can open to expose the paper conveyance path where the conveyance unit 30 will convey the paper, is provided in the front face (on the right side in FIG. 1) of the housing 12. The front cover 40 is prohibited (locked) from opening, except the case where a paper jam occurs as will be described later or the case where a user inputs an instruction. The unlocked front cover 40 can be opened when a grip 42 is pulled toward the user's side. When the front cover 40 is opened, a hand can be inserted into an insertion hole 44 (see FIG. 8). Thus, the paper with which the paper conveyance path clogs can be extracted.

As shown in FIG. 1, a lock mechanism 46 for prohibiting the front cover 40 from opening includes a hook-like member 46*a* and an actuator 46*b*. The hook-like member 46*a* is provided in the front cover 40. The actuator 46*b* is rotatably supported on the body side so that the actuator 46*b* can be engaged with and separated from the hook-like member 46*a*. When the actuator 46*b* is engaged with the hook-like member 46*a*, the front cover 40 is locked to be closed. When the actuator 46*b* is rotated by the driving force of a locking motor 128 (see FIG. 6) so as to leave the hook-like member 46*a*, the front cover 40 is unlocked. A control unit 100 (see FIG. 6), which will be described later, controls driving of the locking motor 128.

Incidentally, a guide member 24*a* forming a part of the paper conveyance path is provided integrally with the front cover 40. When the front cover 40 is opened, the guide member 24*a* moves together so as to expose the paper conveyance path. In addition, a guide plate 24*b* and a feed roller 26*a* are provided integrally with the conveyance unit 30 so as to move up/down in accordance with the up/down motion of the conveyance unit 30 as will be described later. When the guide plate 24*b* and the feed roller 26*a* move down together with the conveyance unit 30, a hand can be inserted from the insertion hole 44 to the recording head 14 (see FIG. 8).

Figure 4:
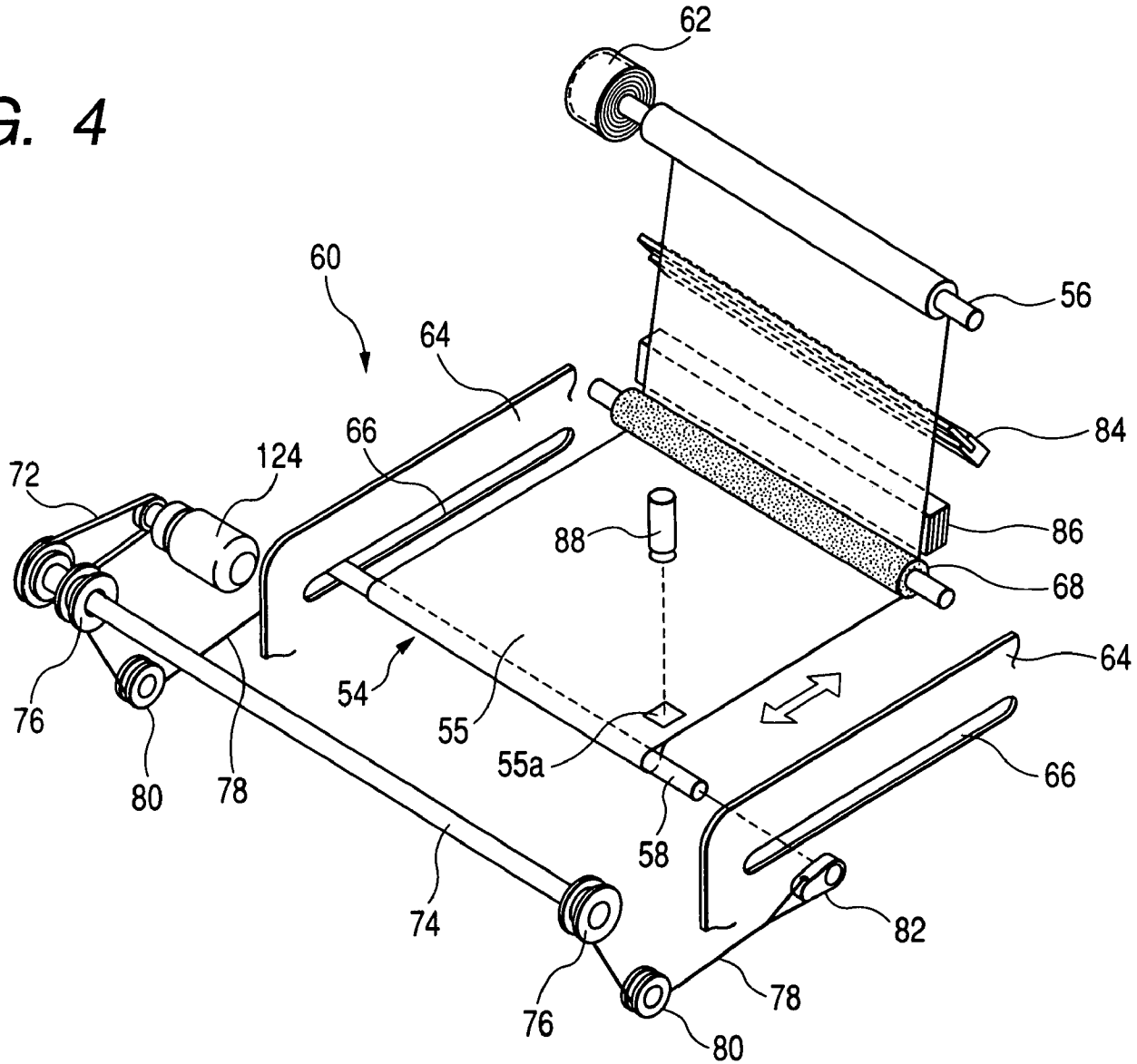
FIG. 4 is a perspective view showing the configuration of a shutter mechanism 50.
Figure 5:
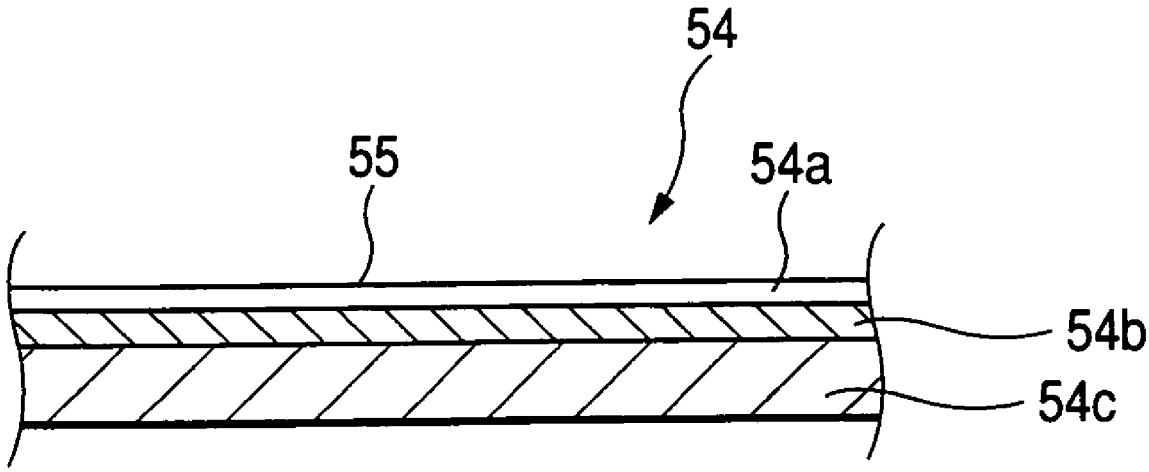
FIG. 5 is a side view showing the configuration of a shutter 54.

Next, with reference to FIGS. 4 and 5, description will be made on the shutter mechanism 50 for protecting the recording heads 14 when the front cover 40 is opened. FIG. 4 is a perspective view showing the configuration of the shutter mechanism 50. FIG. 5 is a side view showing the configuration of a shutter 54.

The shutter mechanism 50 incldues a storage portion 52 (see FIG. 1), the shutter 54 and a moving mechanism 60. The shutter 54 is formed out of a flexible sheet, and is wound like a roll and stored in the storage portion 52. The moving mechanism 60 moves the shutter 54 between a position where the shutter 54 faces the ejection surfaces 18, and the storage portion 52.

The shutter 54 is a sheet-like member having a size large enough to cover the ejection surfaces 18. The end portion of the shutter 54 on the side of the storage portion 52 is wound on a winding shaft 56, while the other end portion thereof is wound on a guide shaft 58. The shutter 54 is stored like a roll in the storage portion 52, so that the housing 12 can be prevented from increasing in size.

The shutter 54 is a flexible sheet member having a multilayer structure. As shown in FIG. 5, the shutter 54 has a configuration in which a water repellent layer 54*a*, a base sheet 54*b* and a sponge-like shock absorbing layer 54*c* are laminated integrally in that order. Here, the surface of the water repellent layer 54*a*, which will face the ejection surfaces 18, is regarded as a facing surface 55. When a hand touches one of the ejection surfaces 18 directly, ink in any one of the nozzles 19*a* of the head body 16 leaks out from the ejection port due to surface tension or capillary attraction so that the meniscus is broken. However, when the facing surface 55 of the shutter 54 touches the ejection surface 18, the influence of the capillary attraction can be weakened due to the water repellency given to the facing surface 55. Thus, the ink in the nozzle is prevented from leaking out, so that there is no fear that the meniscus is broken. In addition, the shock absorbing layer 54*c* has an effect of relieving a shock caused by the touch, so as to prevent the meniscus from being broken.

The shutter 54 configured thus is wound like a roll on the winding shaft 56 and stored in the storage portion 52 during printing. When the front cover 40 is opened, the moving mechanism 60 moves the shutter 54 to a position facing the ejection surfaces 18, so as to protect the recording heads 14.

As shown in FIG. 4, the moving mechanism 60 includes a spiral spring 62, a chassis 64, a sponge roller 68, and a driving force transmission mechanism for transmitting a driving force for moving the guide shaft 58.

The spiral spring 62 is connected to one end of the winding shaft 56 so as to urge the winding shaft 56 in a direction to take up the shutter 54. Guide grooves 66 are formed in the chassis 64. The both ends of the guide shaft 58 are inserted into the guide grooves 66 so that the guide grooves 66 guide movement of the guide shaft 58. The guide grooves 66 are formed so that the guide shaft 58 can move at a distance from the ejection surfaces 18 and in parallel to the ejection surfaces 18. The sponge roller 68 is pivoted on a side nearer the storage portion 52 than the recording heads 14. The sponge roller 68 guides the moving path of the shutter 52 and absorbs ink adhering to the facing surface 55.

The shutter 54 can move at a predetermined distance from the ejection surfaces 18 and in parallel to the ejection surfaces 18 by the guide grooves 66 and the sponge roller 68. Thus, menisci of ink in the nozzles 19*a* are prevented from being broken due to vibration or the like caused by the shutter 54 touching the ejection surfaces 18 during its movement.

The driving force transmitting mechanism includes a shutter motor 124, a belt 72 for transmitting the driving force of the shutter motor 124, a driving shaft 74 having the belt 72 laid thereon and supported rotatably, driving pulleys 76 provided on the driving shaft 74, winding wires 78 to be taken up by the driving pulleys 76, guide pulleys 80 for guiding the winding wires 78, and wire ends 82 each attached to an opposite end portion of the wiring wire 78 to the side where the winding wire 78 is connected to the driving pulley 76. The wire end 82 connects the guide shaft 58 and the winding wire 78.

The winding wires 78 are taken up in accordance with the rotation of the driving pulleys 76, so that the guide shaft 58 is moved. When the shutter motor 124 rotates forward, the driving pulleys 76 rotate due to the driving force of the shutter motor 124 transmitted through the driving shaft 74.

According to the configuration described above, with the movement of the guide shaft 58, the shutter 54 moves from the storage portion 52 to the facing position where the facing surface 55 faces the ejection surfaces 18. As shown in FIG. 4, a marker 55*a* having a low light reflectance is provided in the facing surface 55 of the shutter 54 near the guide shaft 58. As soon as the shutter 54 reaches the facing position, the marker 55*a* is detected by a photo-sensor 88 (see FIG. 4), which functions as an arrival detection unit provided on the downstream side of the recording heads 14 in the conveyance direction.

On the contrary, when the shutter motor 124 rotates backward, the shutter 54 is retracted like a roll in the storage portion 52. When the shutter motor 124 rotates backward, the tension applied to the winding wires 78 is reduced so that the winding shaft 56 rotates due to the urging force of the spiral spring 62. Thus, the shutter 54 is taken up like a roll.

Incidentally, in the storage portion 52, ink adhering to the facing surface 55 when the shutter 54 is taken up by the winding shaft 56 may adhere to the opposite surface of the shutter 54 to the facing surface 55. In this case, there is a possibility that the hand of the user is smeared with the ink at the time of dealing with a paper jam. Therefore, a wiper 84 functioning as a cleaning mechanism for wiping off the back surface of the shutter 54 and an ink reception member 86 for receiving ink dropping from the wiper 84 are provided.

Figure 6:
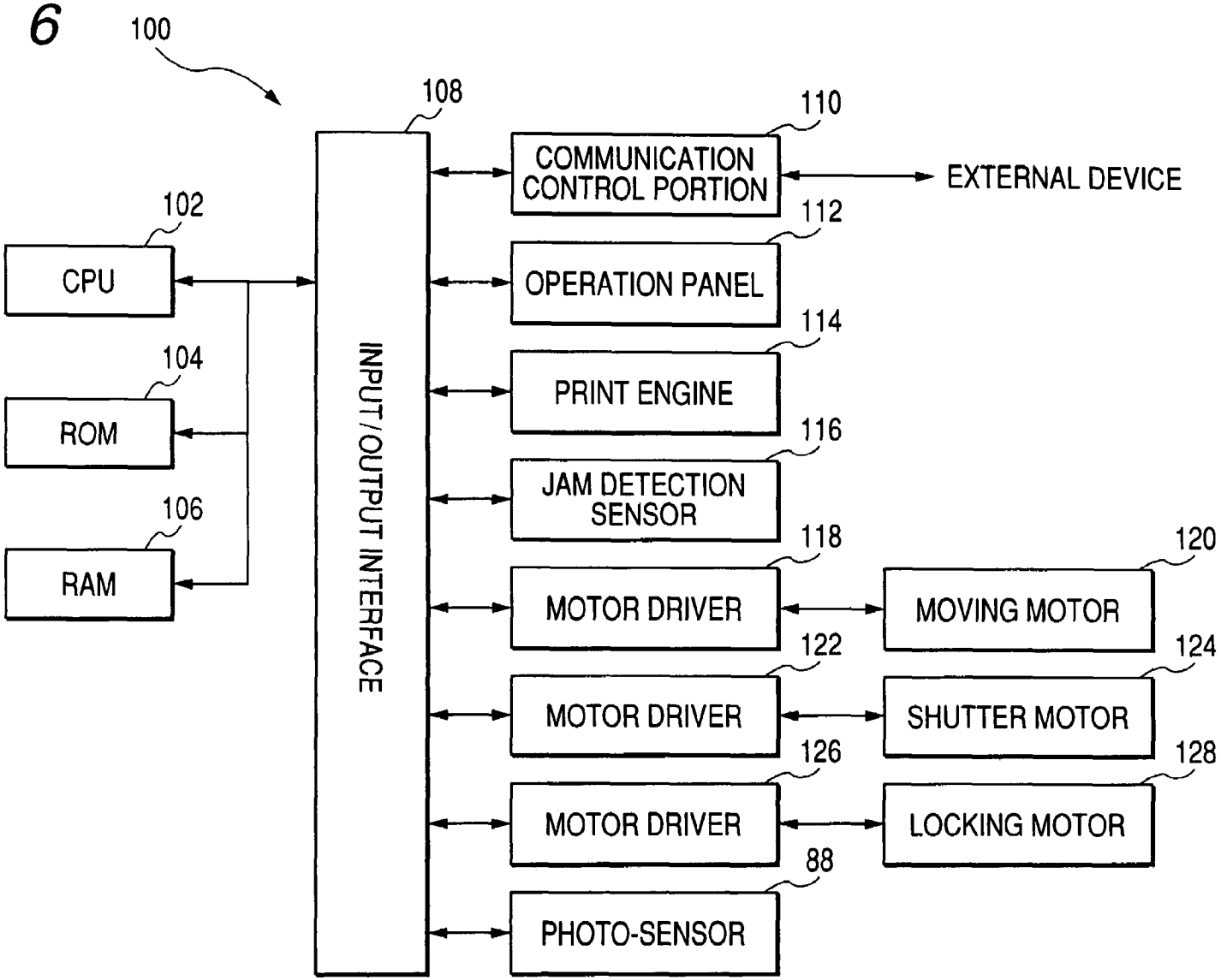
FIG. 6 is a block diagram showing the configuration of a control unit 100 of the inkjet printer 10.

Next, with reference to FIG. 6, description will be made on the control unit 100 for controlling each part of the inkjet printer 10. FIG. 6 is a block diagram showing the configuration of the control unit 100 of the inkjet printer 10.

The control unit 100 of the inkjet printer 10 includes a main processing unit constituted by a CPU 102 (central processing unit), a ROM 104 and a RAM 106. A communication control portion 110 for controlling communications with external device such as a host computer, an operation panel 112 functioning as an input unit for the user, a print engine 114 for controlling a printing operation, a jam detection sensor 116 for detecting a paper jam, motor drivers 118, 122 and 126, and a photo-sensor 88 are connected to an input/output interface 108 connected to the main processing unit.

The CPU 102 controls each part based on programs or data stored in the ROM 104.

The ROM 104 stores a program for issuing an instruction to the print engine 114 so as to perform printing on paper based on print data received through the communication control portion 110, a program for moving the conveyance unit 30 and the shutter 54 based on detection information of jam detection sensor 116, and so on.

An unlocking key (unlocking instruction input unit) for unlocking the lock of the front cover 40 is provided in the operation panel 112. When the unlocking key is pushed down, an unlocking signal is sent to the CPU 102.

The print engine 114 controls devices concerning the printing operation, such as the recording heads 14, the conveyance unit 30, and the paper feed roller 22 based on print data sent from the CPU 102. The print engine 114 includes actual mechanisms such as drive motors and sensors for driving the conveyance unit 30.

The jam detection sensor 116 includes a plurality of optical sensors and a control unit. The control unit notifies the CPU 102 of the occurrence of a paper jam based on information from the optical sensors. As disclosed in JP-A-2003-63691, which is entirely incorporated herein by reference, the jam detection sensor 116 detects the width of conveyed paper at plural positions, and judges the occurrence of a paper jam based on the difference among the paper widths detected at the plural positions. When a paper jam occurs, the jam detection sensor 116 sends a jam detection signal to the CPU 102. Incidentally, the method for detecting a paper jam is not limited to the aforementioned method.

The motor driver 118 is a device for controlling the moving motor 120 functioning as a driving source for moving up/down the conveyance unit 30 based on an instruction of the CPU 102. The motor driver 122 is a device for controlling the shutter motor 124 based on an instruction of the CPU 102. The motor driver 126 is a device for controlling the locking motor 128 for driving the actuator 46*b* of the lock mechanism 46 of the front cover 40 based on an instruction of the CPU 102.

An unlocking unit for controlling each part to thereby unlock the lock of the front cover 40 is implemented by the CPU 102 and programs stored in the ROM 104. The unlocking unit monitors the unlocking signal and the jam detection signal. As will be described later, upon reception of these signals, the unlocking unit moves down the conveyance unit 30, moves the shutter 54 to the facing position, and then controls each part to unlock the lock of the front cover 40.

Figure 7:
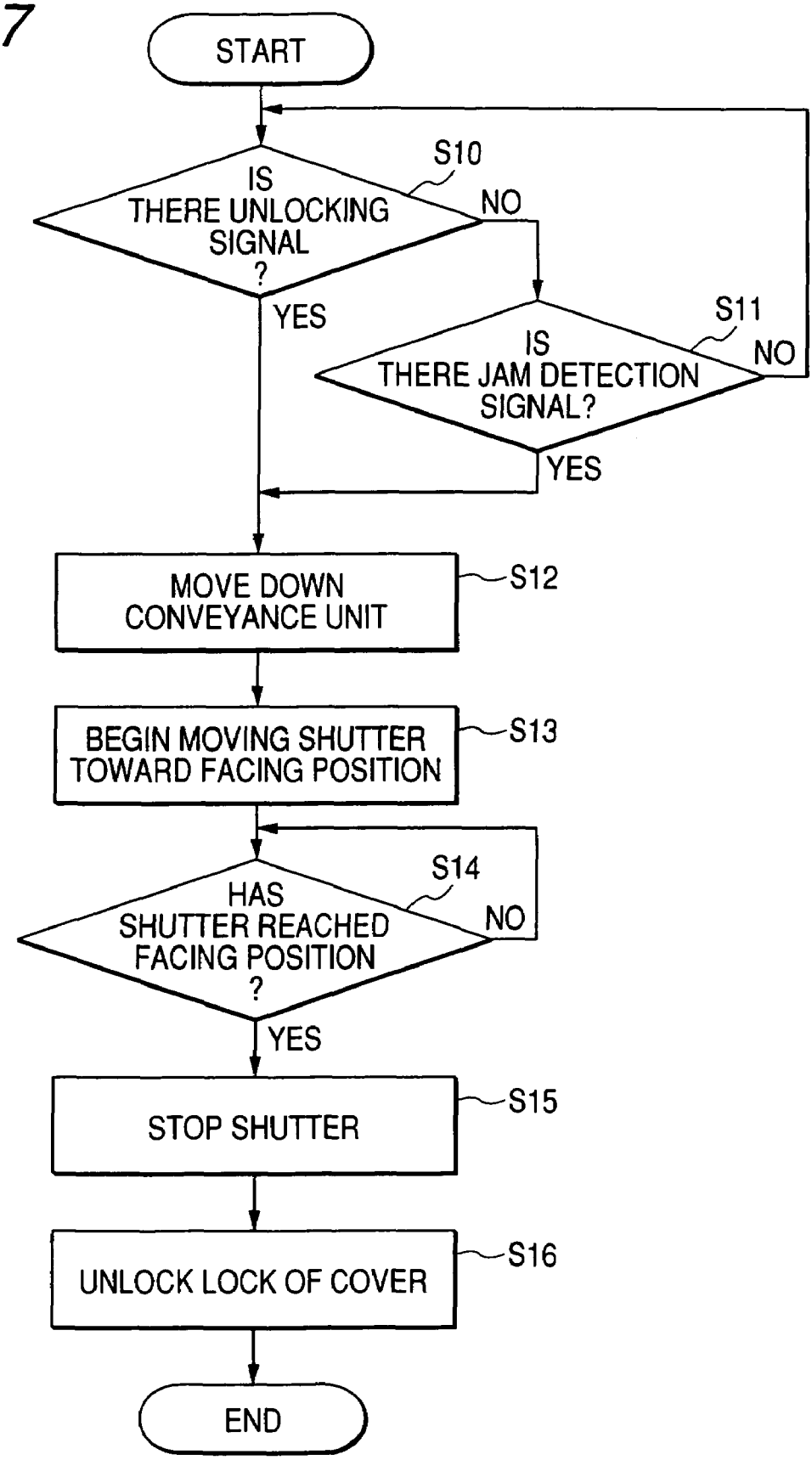
FIG. 7 is a flow chart showing a processing operation of an unlocking unit.
Figure 8:
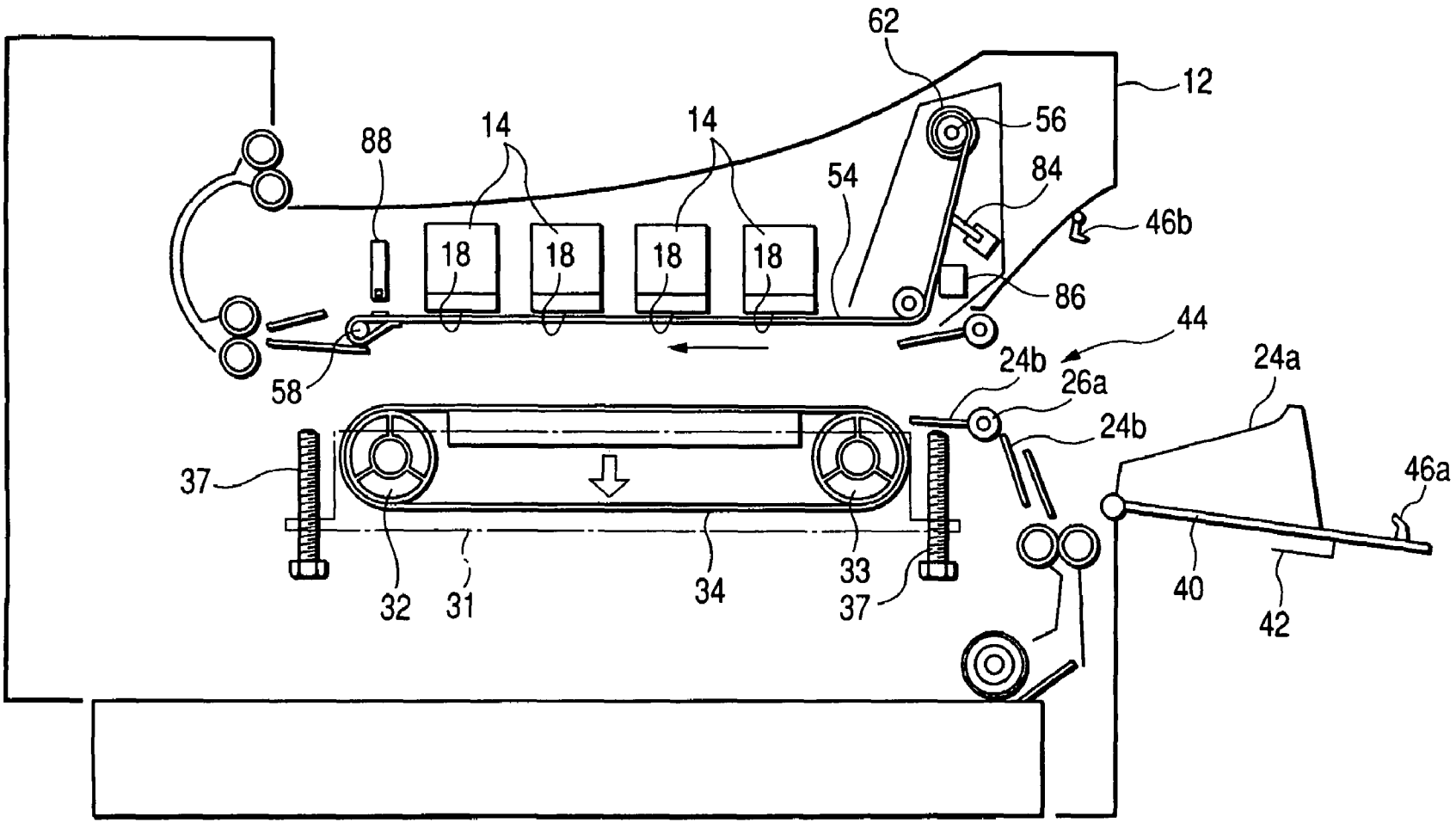
FIG. 8 is a view showing the state of the inkjet printer 10 when a front cover 40 is open.

Next, the operation for opening the front cover 40 in the inkjet printer 10 configured thus will be described with reference to FIGS. 7 and 8. FIG. 7 is a flow chart showing a processing operation of the unlocking unit implemented by the CPU 102. FIG. 8 is a view showing the state of the inkjet printer 10 when the front cover 40 is open.

In Step S10 (hereinafter abbreviated by "S10". The same thing will be applied to other steps) in FIG. 7, the CPU 102 judges whether or not an unlocking instruction for unlocking the lock of the front cover 40 has been issued by the input of the user, based on whether or not the unlocking signal has been detected. When the unlocking signal has not been detected (S10: NO), the CPU 102 advances to the processing of S11 and judges whether or not the jam detection sensor 116 detects a paper jam, based on existence/absence of the jam detection signal. When the jam detection signal has not been detected (S11: NO), the CPU 102 returns to the processing of S10 and repeats the processing of S10 and S11 to keep monitoring the existence/absence of the unlocking signal or the jam detection signal.

When the unlocking signal has been detected in S10 (S10: YES) or when the jam detection signal has been detected in S11 (S11: YES), the CPU 102 advances to the processing of S12.

In S12, the CPU 102 gives an instruction to the motor driver 118 so as to rotate the moving motor 120 forward. Thus, the conveyance unit 30 is moved down to leave the ejection surfaces 18. Then, the CPU 102 controls the moving motor 120 to stop as soon as the conveyance unit 30 moves down to a predetermined position. With this operation, the guide plate 24*b* and the feed roller 26*a* also moves downward. When the conveyance unit 30 moves down, formed are the space where the shutter 54 will face the ejection surfaces 18 and the space where a hand will be inserted between the conveyance unit 30 and the recording heads 14 if a paper jam occurs (see FIG. 8).

Next, in S13, the CPU 102 gives an instruction to the motor driver 122 so as to rotate the shutter motor 124 forward. Thus, the shutter 54 is moved from the storage portion 52 toward the facing position. In this event, the wiper 84 wipes off the back surface of the shutter 54, and wiped ink drops into the cleaner reception member 86 and is absorbed therein. As soon as the shutter motor 124 starts driving, the CPU 102 begins monitoring the existence/absence of the detection signal of the photo-sensor 88 so as to judge whether or not the shutter 54 has reached the facing position (S14).

As soon as the shutter 54 reaches the facing position by means of the moving mechanism 60, that is, as soon as the photo-sensor 88 detects the marker 55*a* of the shutter 54 (S15: YES), the CPU 102 advances to the processing of S15.

In S15, the CPU 102 gives an instruction to the motor driver 122 so as to stop the shutter motor 124. That is, the CPU 102 has a function as a stop control unit for controlling the shutter motor 124 so as to stop the shutter 54 at the facing position, based on the detection information of the photo-sensor 88 (functioning as an arrival detection unit).

After that, the CPU 102 gives an instruction to the motor driver 126 so as to unlock the lock of the front cover 40. Thus, the locking motor 128 is driven to unlock the engagement between the actuator 46*b* and the hook-like member 46*a* (S16).

As shown in FIG. 8, in this state, the ejection surfaces 18 of the recording heads 14 are placed under the protection of the shutter 54. That is, when the front cover 40 is opened for an operation of inserting a hand between the recording heads 14 and the conveyance unit 30 to solve a paper jam, even if the hand acts to give a shock to any one of the ejection surfaces 18, the shock will be absorbed by the shutter 54 so as to protect the recording heads 14 from the shock. In addition, due to the water repellent treatment applied to the facing surface 55 of the shutter 54, ink in the nozzles will not adhere to the facing surface 55 even if the facing surface 55 touches the ejection surfaces 18. Accordingly, there is no fear that the ink in the nozzles is pulled out to the facing surface 55 and leaks out. Thus, each meniscus can be prevented from being broken, so that the printing quality can be kept.

In addition, since each meniscus is thus retained without being broken, a purging operation for regenerating the meniscus does not have to be performed when printing is resumed immediately after the front cover 40 is closed. Accordingly, printing can be resumed immediately only by a so-called flushing operation for ejecting a very small amount of ink to thereby discharge a very small amount of ink near the ejection ports 19*b*, which has touched the atmosphere and has been increased in viscosity.

Embodiment 2

Figure 9A:
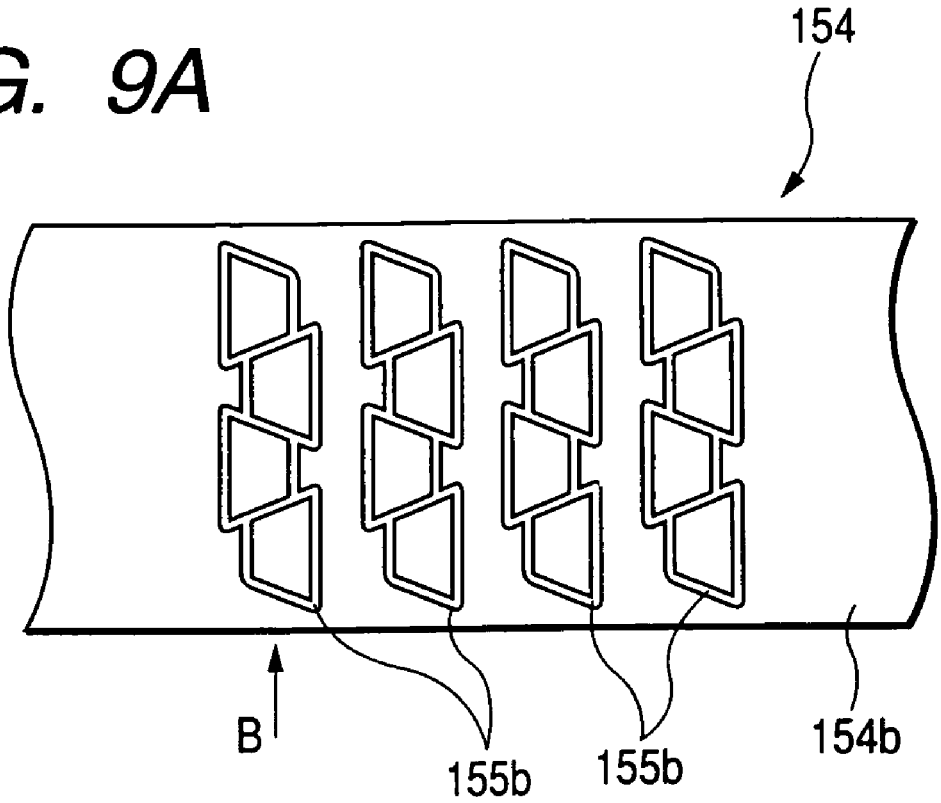
FIGS. 9A and 9B are views showing a shutter 154 according to Embodiment 2 of the invention.
Figure 9B:
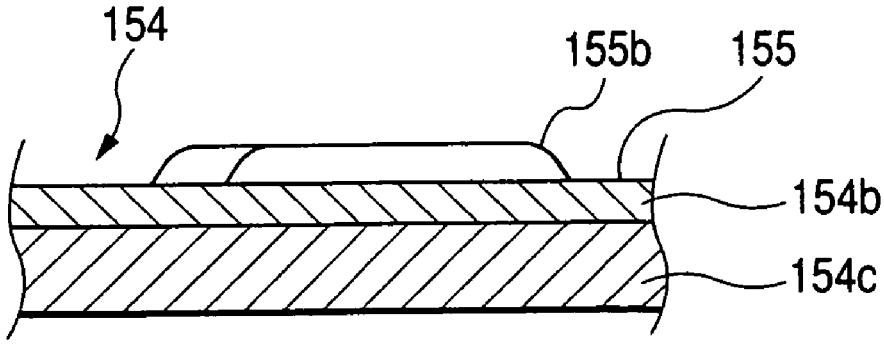

Next, another embodiment of the invention will be described with reference the drawings. Incidentally, description on similar configurations to those in Embodiment 1 will be omitted here. In addition, constituent parts similar to those in Embodiment 1 are denoted by the same reference numerals correspondingly, and a shutter in this embodiment will be referred to as "shutter 154". FIGS. 9A and 9B are views of the shutter 154 according to this embodiment. FIG. 9A is a plan view of the shutter 154, when viewed from the facing surface, and FIG. 9B is a side view of the shutter 154, when viewed from the arrow B direction in FIG. 9A.

The shutter 154 in Embodiment 2 has a configuration in which contact preventing members for preventing the shutter 154 from contacting with the ejection ports are provided on a base sheet 154*b* instead of the water repellent sheet 54*a* of Embodiment 1.

As shown in FIGS. 9A and 9B, in the shutter 154, the base sheet 154*b* and a shock absorbing sheet 154*c* are laminated. Lip members 155*b* that functions as the contact preventing members and are, for example, made of rubber having elasticity are bonded onto the surface (facing surface 155) of the base sheet 154*b*, which faces the ejection surfaces 18.

The lip member 155*b* is provided for each ejection port group 19 correspondingly to the shape of the ejection port group 19 (see FIG. 2). The lip member 155*b* has a gas/steam barrier property such that the lip member 155*b* does not transmit the air or steam. The lip member 155*b* has a loop-like shape continuous to surround the circumference of each ejection port group 19. As shown in FIG. 9B, the lip member 155*b* projects from the base sheet 154*b*.

The base sheet 154*b* in this embodiment has a gas/steam barrier property such that the base sheet 154*b* does not transmit the air or steam. Accordingly, the ejection surfaces 18 can be sealed (capped) by the lip members 155*b* and the base sheet 154*b* having the gas/steam barrier property. The shutter 154 located at the facing position is pressed onto the ejection surfaces 18 so as to cap the ejection surfaces 18 with the shutter 154. The method for capping the ejection surfaces 18 with the shutter 154 will be described in detail later.

Figure 10A:
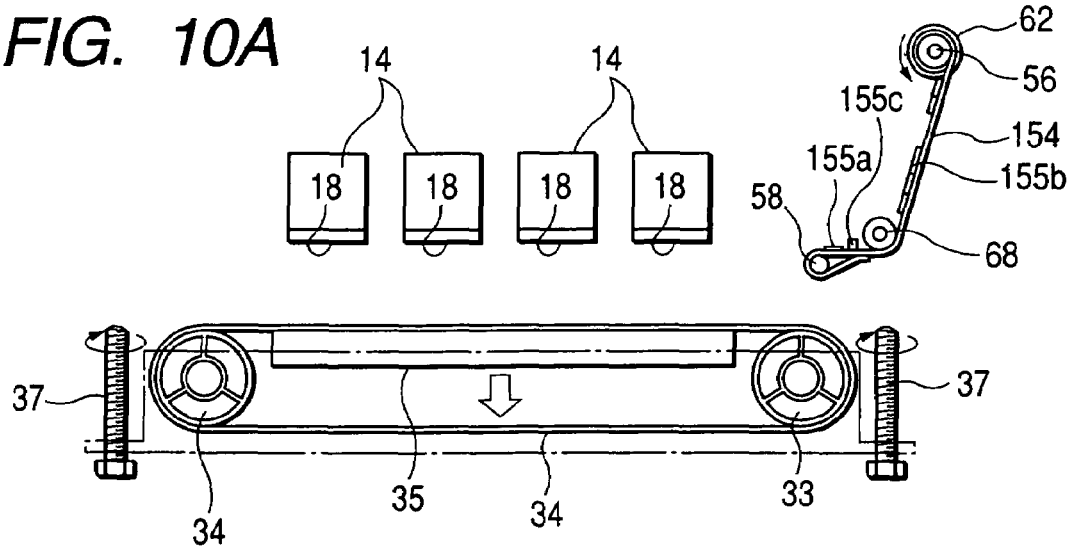
FIGS. 10A to 10C are views showing an operation of capping the ejection surfaces 18 with the shutter 154.
Figure 10B:
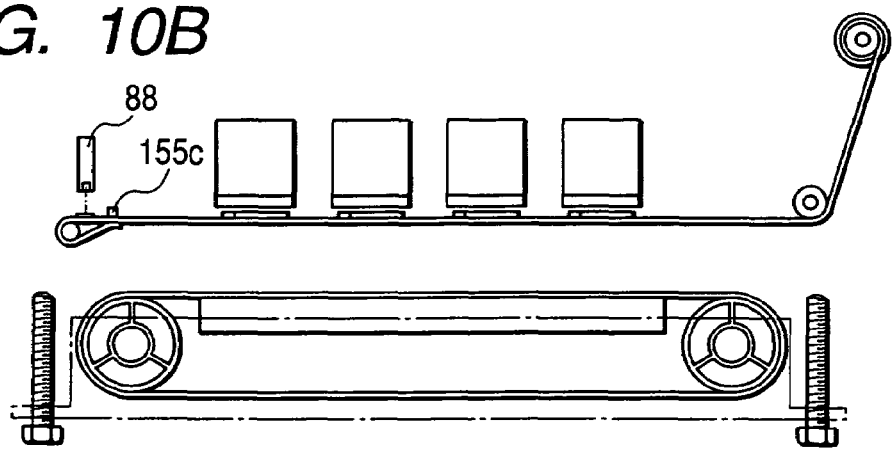
Figure 10C:
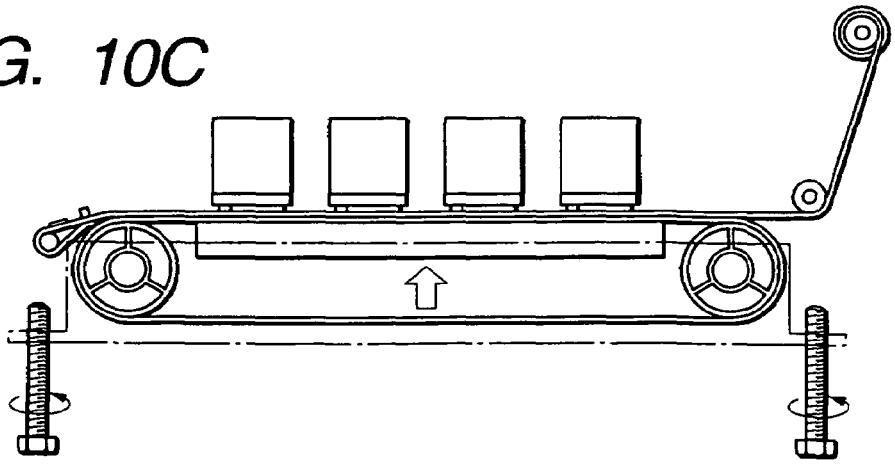

As shown in FIGS. 10A-10C, a marker 155*a* similar to that sin Embodiment 1 is provided on the guide shaft 58 side of the base sheet 154*b* of the shutter 154.

The shutter 154 is moved from the storage portion 52 to the facing position by the moving mechanism 60 in the same manner as in Embodiment 1. Based on the marker 155*a* detected by the photo-sensor 88, the CPU 102 can move the shutter 154 to the position where the lip members 155*b* touch the ejection surfaces 18 around the ejection ports 19*b* without touching the ejection ports 19*b*. Incidentally, the shapes of the guide grooves 66 are formed so that the lip members 155*b* face the ejection surfaces 18 at positions as close to the ejection surfaces 18 as possible. If there were a certain distance between the ejection surfaces 18 and the lip members 155*b* and the shutter 154 were pressed from the opposite side to the facing surface, there would be a possibility that the lip members 155*b* might touch the ejection ports 19*b* to thereby break the menisci in accordance with bending of the shutter 154. When the shutter 154 (lip members 155*b*) is made close to the ejection surfaces 18, the lip members 155*b* can touch the ejection surfaces 18 surely at the position where the lip members 155*b* do not touch the ejection ports 19*b*.

The height of each of the lip members 155*b* from the surface of the base sheet 154*b* is set to be so high that the regions of the shutter 154 surrounded by the lip members 155*b* will not project over the lip members 155*b* or touch the ejection ports 19*b* when the regions are pressed from the back side of the facing surface by finger. This height is designed in consideration of the flexibility of the shutter 154, the positions where the contact preventing members are disposed, and so on.

In addition, it is not necessary for each of the contact preventing members to have the loop-like shape (lip shape) for surrounding each ejection port group 19 as shown in FIG. 9A. It is, however, necessary to dispose the contact preventing members such that the contact preventing members do not touch the ejection ports 19*b* when the shutter 154 at the facing position is pressed from the opposite side to the facing surface 155 of the shutter 154.

As shown in FIG. 10A, a wiper 155*c* made of urethane rubber is provided on the base sheet 154*b* and in the front end portion (near the guide shaft 58) of the shutter 154 in the direction in which the shutter 154 moves to the facing position. By the wiper 155*c*, each ejection surface 18 can be wiped off when the shutter 154 is moved from the storage portion 52 toward the ejection surface 18 by the moving mechanism 60. Incidentally, the material, the shape, etc. of the wiper 155*c* are designed so that the wiper 155*c* does not break menisci when it wipes off the ejection surface 18.

Next, the operation of capping the ejection surfaces 18 with the shutter 154 will be described with reference to FIGS. 10A-10C. As for the method for pressing the shutter 154 at the facing position onto the ejection surfaces 18, the unit moving mechanism 36 for moving up/down the conveyance unit 30 in Embodiment 1 is used. FIGS. 10A-10C are views showing the operation of capping the ejection surfaces 18 with the shutter 154. When a printing operation is terminated, the CPU 102 drives the unit moving mechanism 36 to move down the conveyance unit 30 as shown in FIG. 10A. Thus, the space where the shutter 154 faces the ejection surfaces 18 is formed. After that, as shown in FIG. 10B, the shutter 154 is moved from the storage portion 52 toward the facing position. In this event, ink adhering to the ejection surfaces 18 is wiped out by the wiper 155*c*.

Next, the CPU 102 stops the shutter 154 at the position (facing position) where the photo-sensor 88 detects the marker 155*a*. Then, as shown in FIG. 10C, the conveyance unit 30 is moved up so that the shutter 154 is pushed up to the position where the lip members 155*b* of the shutter 154 press the ejection surfaces 18.

By the aforementioned operation, the ejection surfaces 18 are capped with the shutter 154. The capping is kept till an instruction to perform a subsequent printing operation or an instruction to unlock the lock of the front cover 40 is issued.

Incidentally, when an instruction to perform a printing operation is issued in the state shown in FIG. 10C, the shutter 154 and the conveyance unit 30 are moved in a reverse procedure to that in the case of capping. On the other hand, when an instruction to unlock the lock of the front cover 40 is issued by the input of the user, the conveyance unit 30 is moved down, and the lock of the front cover 40 is unlocked in the state shown in FIG. 10B.

In this embodiment, as described above, the shutter 154 is prevented from directly touching the ejection ports 19*b* by the lip members 155*b* functioning as contact preventing members. Thus, menisci are protected.

In addition, the shutter 154 has a function of not only protecting the menisci but also capping the ejection surfaces 18. Accordingly, no other member or mechanism for capping is required. Thus, the apparatus cost can be reduced.

As described above, according to the embodiments of the invention, a hand is prevented from touching any one of the recording heads 14 directly and being smeared, and menisci of ink in the nozzles 19*a* of the recording heads 14 can be prevented from being broken. Thus, the printing quality can be kept.

Accordingly, a purging operation is not required when printing is to be resumed immediately after the front cover 40 is closed. Printing can be resumed immediately only by a so-called flushing operation for ejecting a very small amount of ink.

Although the preferred embodiments of the invention have been described above, the invention is not limited to the embodiments. Suitable changes can be made within the scope recited in claims.

Figure 11:
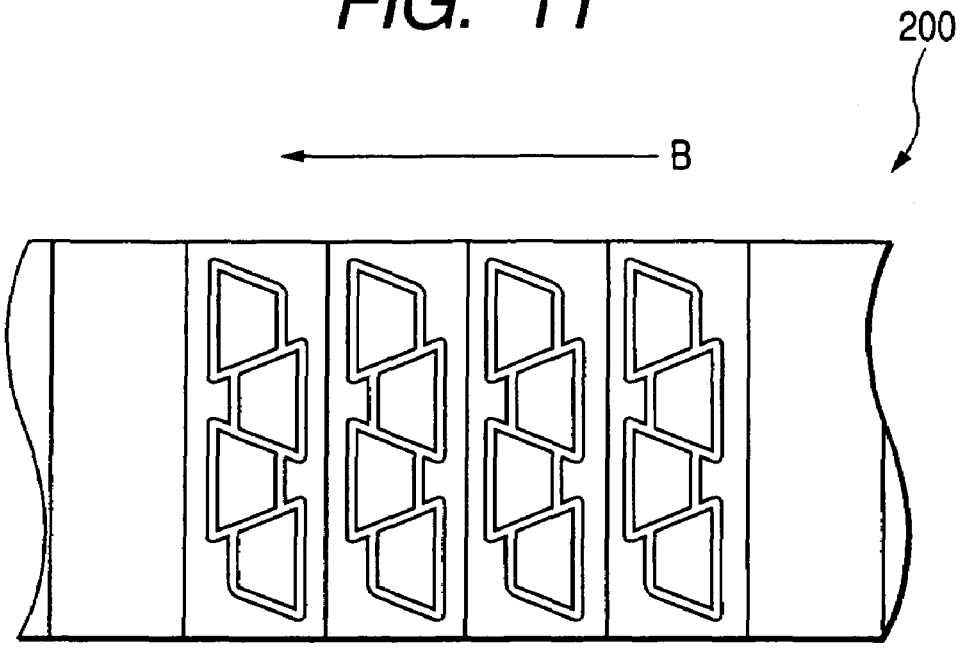
FIG. 11 is a plan view of a shutter 200.

For example, the shutter 54 or 154 in the embodiments maybe replaced with a shutter 200 shown in FIG. 11. The shutter 200 is formed out of not a flexible sheet but a plurality of metal plates each having a strip sheet-like shape. The metal plates are connected to be contiguous to one another in the direction (the arrow B direction in FIG. 11) where the moving mechanism 60 conveys the shutter 200. FIG. 11 shows the shutter 200 as a modification of the shutter 154 shown in FIG. 9A, in which the shutter 154 is formed out of a plurality of strip sheets connected to one another. When a shutter like the shutter 200 is formed out of strip sheets connected to one another, the shutter can be moved while being bent. Thus, the degree of freedom in setting the shutter moving path is enhanced in comparison with the case where a shutter is formed out of one metal plate. In addition, the shutter can be stored like a roll so that the apparatus can be prevented from increasing in size.

Figure 12:
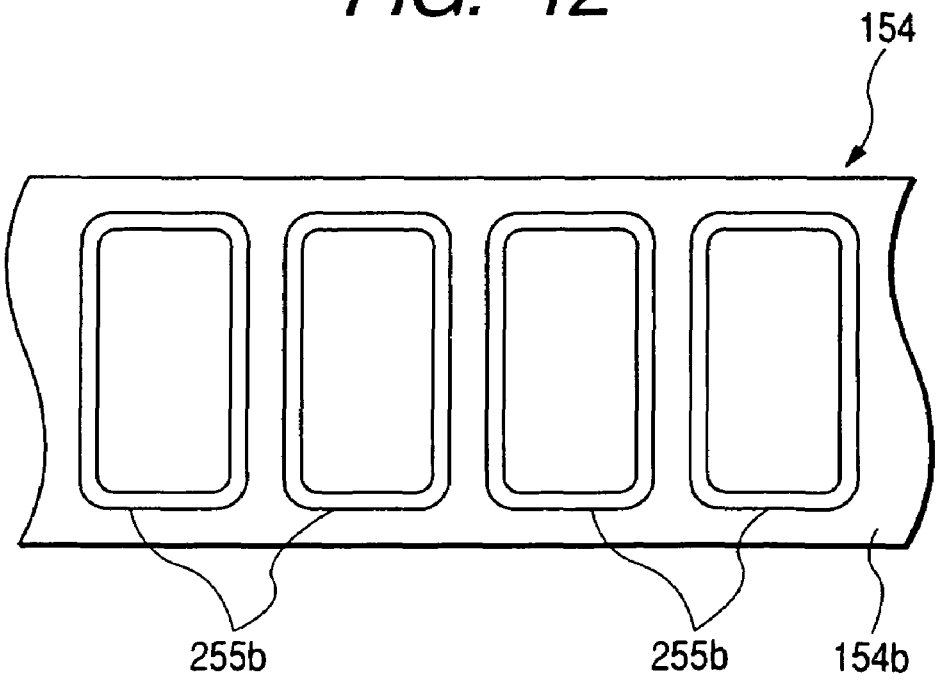
FIG. 12 is a plan view of the shutter 154 including lip members 255*b* according to a modification example.

Alternatively, the shatter 154 may include lip members 255*b* as shown in FIG. 12 in place of the lip members 155*b*. FIG. 12 is a plan view of the shutter 154 including the lip members 255*b*, when viewed from the facing surface. Each of the lip members 255*b* has a rectangular loop-like shape continuous to surround plural ejection port groups 19. In comparison with the lip member 155*b*, the lip member 255*b* has a simple shape and therefore, it is easy to design and manufacture the lip member 255*b*. The lip members 255*b* can cap the ejection ports 19*b* sufficiently as with the lip member 155*b*. In other words, it is not necessary to cap the ejection ports 19*b* in the unit of ejection port group 19.

Figure 13:
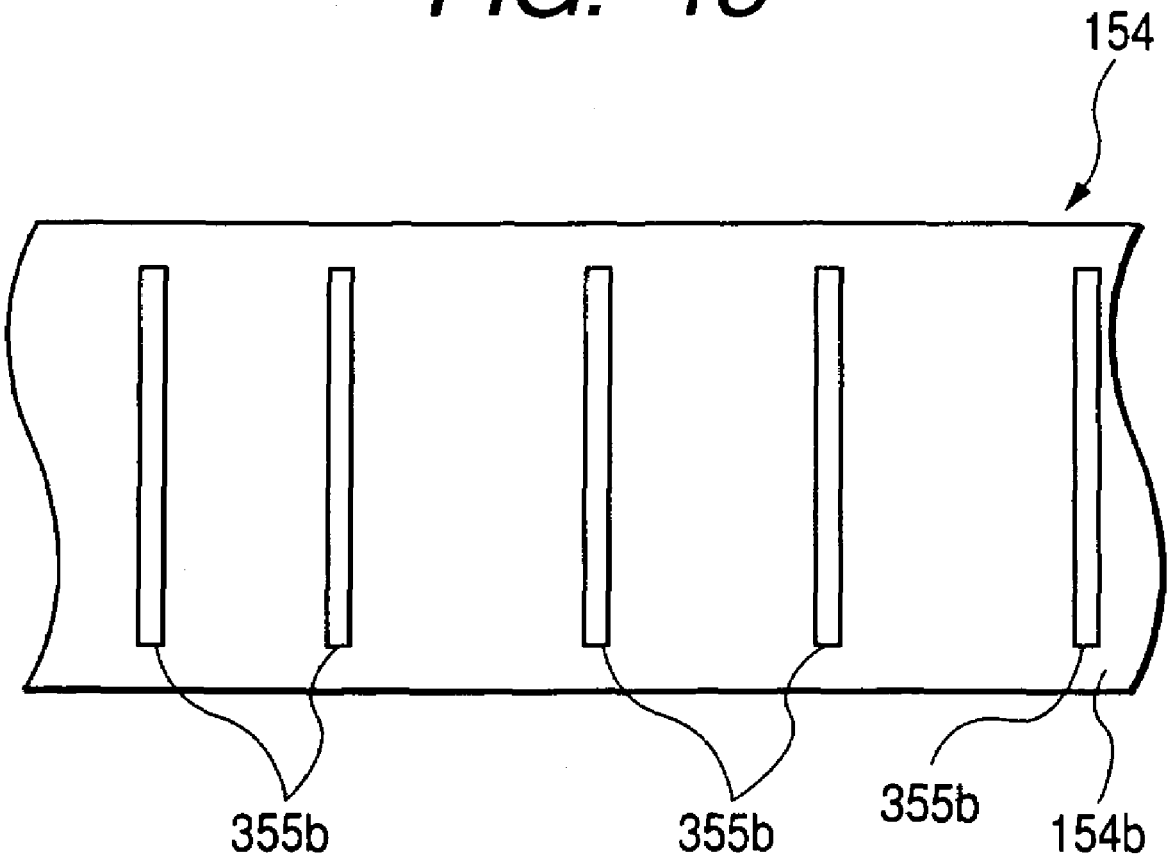
FIG. 13 is a plan view of the shutter 154 including protrusions 355*b* according to another modification example.

Furthermore, the shatter 154 may include protrusions 355*b* as shown in FIG. 13 in plate of the lip members 155*b*. FIG. 13 is a plan view of the shutter 154 including the protrusion 355*b*, when viewed from the facing surface. The protrusions 355*b* are different from the lip members 155*b* in that the protrusions 355*b* do not surround the circumference of each ejection port group 19. In other words, the protrusion 355*b* cannot cap the ejection port 19. However, the protrusion 355*b* can prevent a hand from touching any one of the recording heads 14 directly and being smeared, and also prevent menisci of ink in the nozzles 19*a* of the recording heads 14 from being broken. Thus, the printing quality can be kept.

As for the method for retracting/moving the shutter, the shutter does not have to be moved while the shutter stored like a roll is unwound. For example, guide grooves each having a recumbent-U shape may be provided so that the shutter can move bypassing the recording heads 14 from above the recording heads 14 and face the ejection surfaces 18. The winding shaft 56 and the guide shaft 58 may move in engagement with the guide grooves.

As for the unit moving mechanism 36 for moving the conveyance unit 30, the invention is not limited to the configuration according to the embodiments, but various forms can be considered. For example, the surfaces of guide shafts 37 may be smoothened, while a cam is brought into contact with the lower surface of the frame 31 so as to allow the conveyance unit 30 to slide on the guide shafts 37 as if the guide shafts 37 are pushed up by the rotation of the cam.

As for the direction to separate the conveyance unit 30 from the ejection surfaces 18, the invention is not limited to the lifting motion in the up/down direction. For example, the belt roller 32 side of the frame 31 maybe supported rotatably so that the conveyance unit 30 can be swung to allow a hand or the like to be inserted between the conveyance unit 30 and the ejection surfaces 18.

As for the method using the arrival detection unit to detect that the shutter moved by the moving mechanism 60 has reached the facing position, the invention is not limited to the detection method using the photo-sensor 88 and the marker, but various forms may be applied. The number of rotation steps of the shutter motor 124 may be counted after the movement of the shutter from the storage portion 52 is initiated. In this case, as soon as the counted number of rotation steps reaches a predetermined step number, it is judged that the shutter has reached the facing position.

What is claimed is:

1. An inkjet printer comprising:

a recording head including an ejection surface in which an ejection port for ejecting ink is defined;

a conveyance mechanism that conveys a printing medium while the printing medium is facing the ejection surface;

a shutter that covers the ejection surface;

a storage portion that stores the shutter;

a moving mechanism that moves the shutter from the storage portion to a facing position while the shutter is separate from the ejection surface, wherein the shutter faces and covers the ejection surface at the facing position;

a casing in which the recoding head is disposed;

a cover that is disposed on an outer surface of the casing and is openable to expose a conveyance path along which the conveyance mechanism conveys the printing medium;

a lock mechanism that prohibits the cover from being opened; and an unlocking unit that cancels the prohibiting of opening the cover when the shutter is located at the facing position.

2. The inkjet printer according to claim 1, further comprising:

an unlock-instruction input unit that allows a user to input an instruction for canceling the prohibiting of opening the cover, wherein:

when the instruction for canceling the prohibiting of opening the cover is input through the unlock-instruction input unit, the unlocking unit controls the moving mechanism to move the shutter to the facing position, and cancels the prohibiting of opening the cover after the shutter reaches the facing position.

3. The inkiet printer according to claim 1, further comprising:

a jam detection sensor that detects whether or not a paper jam occurs, wherein:

when the jam detection sensor detects that a paper jam occurs, the unlocking unit controls the moving mechanism to move the shutter to the facing position, and cancels the prohibiting of opening the cover after the shutter reaches the facing position.

4. The inkjet printer according to claim 1, wherein a facing surface of the shutter, which faces the ejection surface, has a water-repellent property.

5. The inkjet printer according to claim 1, further comprising:

a contact preventing member that is disposed on a facing surface of the shutter, which faces the ejection surface, and prevents the shutter from contacting the ejection port;

an arrival detection unit that detects whether or not the shutter moved by the moving mechanism arrives the facing position; and a stop control unit that controls the moving mechanism to stop the shutter at the facing position, based on detection information of the arrival detection unit, wherein:

the facing position is a position where when the shutter is pushed toward the ejection surface by an external force, the contact preventing member contacts with a circumference of the ejection port without contacting with the ejection port.

6. The inkjet printer according to claim 5, wherein:

a plurality of ejection port groups each of which includes a plurality of ejection ports are formed on the ejection surface; and the contact preventing member includes a plurality of contact preventing units that correspond to the ejection port groups, respectively.

7. The inkjet printer according to claim 5, further comprising:

a conveyance-mechanism moving unit that moves the conveyance mechanism in a direction approaching the ejection surface, wherein:

a region, which is surrounded by the contact preventing member, on the facing surface of the shutter has a gas/steam barrier property;

the contact preventing member has a lip shape that cooperates with the facing surface of the shutter to seal a region where the ejection port is disposed on the ejection surface; and when the conveyance-mechanism moving unit moves the conveyance mechanism, the conveyance mechanism presses the shutter toward the ejection surface and the shutter closely seals the ejection port.

8. The inkjet printer according to claim 5, wherein the contact preventing member includes a protrusion that protrudes from the facing surface of the shutter.

9. The inkjet printer according to claim 1, wherein the shutter has a shock absorbing property.

10. The inkjet printer according to claim 9, wherein the shutter has a laminated structure including a shock absorbing layer.

11. The inkjet printer according to claim 1, wherein the shutter has flexibility.

12. The inkjet printer according to claim 1, wherein the shutter includes a plurality of strip sheets connected contiguously in a direction in which the moving mechanism moves the shutter.

13. The inkjet printer according to claim 1, wherein the shutter includes a wiper that wipes off the ejection surface when the moving mechanism moves the shutter from the storage portion to the facing position.

14. The inkjet printer according to claim 13, wherein the wiper is provided in a front end portion of the shutter in a direction in which the moving mechanism moves the shutter to the facing position.

15. The inkj et printer according to claim 1, wherein the shutter is wound in a roll state and stored in the storage portion.

16. The inkjet printer according to claim 15, further comprising:

a cleaning mechanism that cleans an opposite surface of the shutter to a surface thereof, which faces the ejection surface.

* * * * *